US006135816A

United States Patent [19]

Mashiyama

[11] Patent Number: 6,135,816

[45] Date of Patent: Oct. 24, 2000

[54] ELECTRICAL CONNECTOR HAVING AN IMPROVED CONSTRUCTION FOR FIXING SHIELD PLATES TO A RECEPTACLE CONNECTOR

[75] Inventor: Jin-ichi Mashiyama, Tokyo, Japan

[73] Assignee: DDK Ltd., Tokyo, Japan

[21] Appl. No.: 09/299,127

[22] Filed: Apr. 26, 1999

[30] Foreign Application Priority Data

Apr. 27, 1998 [JP] Japan ..... 10-132753

[51] Int. Cl.[7] ..... H01R 13/648

[52] U.S. Cl. ..... 439/607

[58] Field of Search ..... 439/607

[56] References Cited

U.S. PATENT DOCUMENTS 5,967,845 10/1999 Ho et al. ..... 439/607

*Primary Examiner*—Lincoln Donovan
*Assistant Examiner*—Javaid Nasri
*Attorney, Agent, or Firm*—Baker Botts L.L.P.

[57] ABSTRACT

An electrical connector includes a pin connector and a receptacle connector. The pin connector includes a housing and pin contacts fixed to the housing. The receptacle connector includes contact assemblies each having an insulator and receptacle contacts fixed to the insulator; a connecting fixture for holding the contact assemblies; a block into which the contact assemblies are inserted, and first and second shield plates mounted on the block. The first shield plate has a substantially L-shaped cross-section and includes a required number of first anchoring pieces extending from its one free end and projections at tip ends of terminals on the other free end. The second shield plate includes a required number of second anchoring pieces extending from its one free end and anchoring portions to engage the terminals of the first shield plate. The block has flanges at both the ends in its width direction, the flanges having engagement portions for receiving therein the first and second anchoring pieces of the first and second shield plates. With the electrical connector thus constructed, there is no risk of the first and second shield plates moving away from the block, and there is no risk of the pin contacts and the first and second shield plates being deformed when the pin connector and the receptacle connector are connected. This electrical connector is easy to assemble and easy to mount the respective shield plates onto the receptacle connector.

12 Claims, 7 Drawing Sheets

ELECTRICAL CONNECTOR HAVING AN IMPROVED CONSTRUCTION FOR FIXING SHIELD PLATES TO A RECEPTACLE CONNECTOR

BACKGROUND OF THE INVENTION

This invention relates to an electrical connector to be mounted on a circuit board in an electrical or electronic appliance, and more particularly to an improved construction for fixing shield plates to a receptacle connector.

In general, an electrical connector comprises a pin connector (for example, refer to numeral 32 in FIG. 1) and a receptacle connector (numeral 74 in FIG. 7). A construction of a hitherto used receptacle connector 74 will be explained by way of example with reference to FIG. 7 which is a perspective view illustrating the conventional receptacle connector 74, a first shield plate 80 and a second shield plate 90. As shown in FIG. 7, the conventional receptacle connector 74 mainly comprises a block 76, contact assemblies 16 and a connecting fixture 20. The contact assembly 16 comprises an insulator 17 made of a plastic material and receptacle contacts 18 made of a metallic material which are fixed in the insulator 17 by press-fitting or by embedding them into the insulator in molding.

The receptacle contact 18 is made as by the known press-working and comprises a connecting portion to be connected to a board, a fixed portion to be fixed to the insulator 17 and a contacting portion to contact the pin contact 36 of a pin connector 32. The insulator 17 is made of an insulating plastic material by the known injection molding or the like.

The connecting fixture 20 is also made of an insulating plastic material by the known injection molding. The connecting fixture 20 holds and fixes thereto the contact assemblies 16 with their protrusions 62 being fitted in latching portions 60 of the connecting fixture 20 (refer to FIG. 2A). The connecting fixture 20 serves to fix the contact assemblies 16 without any misalignment and to make possible to insert all the contact assemblies 16 as a unit into the block 76 by one operation. The contacting fixture 20 has been proposed in Japanese Patent Application No. H10-64,099 filed by the applicant of the present application.

The block 76 will be explained herein. It is also made of an insulating plastic material by the known injection molding. The block 76 is formed with insertion apertures (not shown) into which a required number of the contact assemblies 16 are inserted by press-fitting at one end of the block in the direction of its thickness. The block 76 is further formed in the other end with fitting openings 22 into which pin contacts 36 of the pin connector 32 (refer to FIG. 1) are inserted. On the same side of the fitting openings 22, the block 76 is further provided with a misinsertion preventing groove 24 substantially at the center of its length. A key (not shown) is provided on the pin connector 32 to be fitted into the groove 24 to prevent misalignment insertion of the pin connector 32 into the receptacle connector 74.

Engagement portions 78 are provided on the block 76 at the ends in its width direction (the vertical direction viewed in FIG. 7) near to the fitting opening 22. The engagement portions 78 at one end are adapted to be fitted with a first anchoring pieces 86 of the first shield plate 80, and the engagement portions 78 at the other end adapted to be fitted with a second anchoring pieces 88 of the second shield plate 90. The first and second shield plates 80 and 90 are fitted on the engagement portions 78 in this manner to prevent any floating movement of these shield plates 80 and 90 from the block 76.

A plurality of projections 28 are further provided in a predetermined pitch on the block 76 at the either ends in its width direction (the vertical direction viewed in FIG. 7) on the side of the contact assemblies 16. When the first and second shield plates 80 and 90 are fitted on the receptacle connector 74, these projections 28 are inserted into recesses 48 of the first and second shield plates 80 and 90, thereby ensuring the correct positioning of the first and second shield plates 80 and 90 relative to the receptacle connector 74 with respect to the directions of the width and thickness of the block 76. The projections 28 have a length of the order of 0.8 mm to 1.2 mm, a width of 2 mm to 3 mm and a height of 0.4 mm to 0.5 mm.

The shield plates will be explained hereinafter. First, explaining the first shield plate 80, it has a substantially L-shaped cross-section and includes at its one free end the first anchoring pieces 86 to be fitted on the engagement portions 78 of the block 76 and at the other free end a required number of terminals 84 extending therefrom, which are to be forced into a board (not shown) by press-fitting. At substantially mid position between the adjacent terminals 84, the first shield plate 80 is formed with notches 82 into which are inserted the terminals 84 of the second shield plate 90. The notches 82 serve to fix the first and second shield plates 80 and 90 with each other.

Near to the first anchoring pieces 86, the first shield plate 80 is formed with contacting portions 46 which are bent outwardly so that they can contact pin contacts 36 (refer to FIG. 1) located near to the outer end of the pin connector 32 for grounding. As described above, near to the contacting portions 46 of the first shield plate 80 is provided with the recesses 48 so located and sized that the projections 28 of the block 76 are fitted in the recesses 48. Moreover, the first shield plate 80 is formed with a relief space 56 to facilitate the mounting of the shield plate onto the block 76.

Then, the second shield plate 90 will be explained hereinafter. The second shield plate 90 has a substantially L-shaped cross-section and includes at its one free end the second anchoring pieces 88 to be fitted on the engagement portions 78 of the block 76 and at the other free end a required number of terminals 84 extending therefrom, which are to be forced into a board (not shown) by press-fitting.

After the terminals 84 have been forced into a board by press-fitting, they are fitted in the notches 82 of the first shield plate 80 to achieve the positional alignment of the first and second shield plates 80 and 90. Near to the second anchoring portions 88, the second shield plate 90 is formed with contacting portions 46 which are bent outwardly so that they can contact pin contacts 36 (refer to FIG. 1) located near to the outer end of the pin connector 32 for grounding. As described above, near to the contacting portions 46 of the second shield plate 90 is provided with the recesses 48 so located and sized that the projections 28 of the block 76 are fitted in the recesses 48. The second shield plate 90 is formed with a relief space 56 for the same purpose in the first shield plate 80.

Finally, the process for assembling the receptacle connector 74 of the prior art will be explained. First, the receptacle contacts 18 are fixed to the insulator 17 by press-fitting, or embedding them in the insulator by molding or the like. The thus formed contact assemblies 16 including the receptacle contacts 18 are mounted on the connecting fixture 20 and the contact assemblies 16 in this condition are press-fitted and fixed into the insertion apertures of the block 76.

Usually, the blocks 76 having the contact assemblies 16 fixed thereto and the shield plates 80 and 90 are separately sent to customers, who, after received these products, may set them on boards. There are two methods for setting these products on boards. In the first method, the receptacle connector 74 and the first shield plate 80 with its first anchoring pieces 86 engaging the engagement portions 78 of the block 76 are simultaneously forced into the board by press-fitting, and thereafter the second anchoring pieces 88 of the second shield plate 90 are brought into engagement with the engagement portions 78 of the block 76 and the second shield plate 90 is forced into the board by press-fitting from the opposite side of the shield plate 80.

In the second method, first the receptacle connector 74 is forced into a board by press-fitting, and thereafter the first anchoring pieces 86 of the first shield plate 80 are engaged with the engagement portions 78 of the block 76 and the first shield plate 80 is forced into the board by press-fitting. Thereafter, the second anchoring pieces 88 of the second shield plate 90 are brought into engagement with the engagement portions 78 of the block 76 and the second shield plate 90 is forced into the board by press-fitting from the opposite side of the shield plate 80.

As described above, the first and second shield plates 80 and 90 are mounted on the block 76 only by hanging their first and second anchoring pieces 86 and 88 on the engagement portions 78 of the block 76 of the receptacle connector 74, so that there is a tendency of the first and second shield plates 80 and 90 to move away from the block 76. As a result, when the pin connector 32 and the receptacle connector 74 are connected to each other, the first and second shield plates 80 and 90 of the receptacle connector 74 are accidentally deformed and even the pin contacts 36 of the pin connector 32 may be damaged. This is a problem to be solved in the prior art.

Such deformations of the pin contacts 36 and first and second shield plates 80 and 90 will cause need for replacement of the board and the pin connector 32 and receptacle connector 74 themselves, with resultant increase of cost. Moreover, as the receptacle connectors 74 and the first shield plates 80 in separated condition are send to customers, the man-hours for the control or management of the respective parts will be increased to increase the cost.

In the case that the receptacle connector 74 and the first shield plate 80 are separately forced into the board by press-fitting according to the customer's method as described above, the press-fitting operation must be effected two times on the same side of the board so that particular jigs must be required for the respective press-fittings and the man-hours for assembling will be increased, resulting in the increase of cost. What is worse still, the second shield plate 90 is forced into the board by press-fitting from the opposite side of the first shield plate 80 so that an exclusive jig is required accompanying a troublesome operation to increase the cost.

SUMMARY OF THE INVENTION

It is an object of the invention to provide an improved electrical connector comprising a pin connector and a receptacle connector, which eliminates the disadvantages of the prior art described above and is easy to assemble and easy to mount shield plates on the receptacle connector without any risk of these shield plates moving away from the connector and without any risk of pin contacts of the pin connector and the shield plates being deformed when the pin connector and receptacle connector are connected.

In order to accomplish this object, in an electrical connector comprising a pin connector and a receptacle connector, said pin connector comprising a housing having a fitting groove in which said receptacle connector is fitted and pin contacts held and fixed to said housing, and said receptacle connector comprising contact assemblies, each of said contact assembly including an insulator and receptacle contacts fixed to said insulator, each receptacle contact having a contacting portion to contact one of said pin contacts, a fixed portion fixed to said insulator and a connecting portion secured in a board by press-fitting; a connecting fixture for holding said contact assemblies with their protrusions engaging latching portions of the connecting fixture; a block including fitting openings into which said pin contacts are inserted, flanges at both the ends in its width direction, insertion apertures on the opposite side of said fitting openings into which said contact assemblies are inserted, and a required number of projections at the ends in the width direction on the side of said insertion apertures; a first shield plate to be mounted on said block and including contacting portions located near to one free end of the first shield plate to contact said pin contacts, a required number of terminals on the other free end to be forced into the board by press-fitting and recesses at locations enabling said projections of said block to be inserted in the recesses; and a second shield plate to be mounted on said block and including contacting portions located near to one free end of the second shield plate to contact said pin contacts and recesses at locations enabling said projections of said block to be inserted in the recesses, according to the invention said first shield plate has a substantially L-shaped cross-section and comprises a required number of first anchoring pieces extending from its one free end and projections at tip ends of said terminals on the other free end, and said second shield plate comprises a required number of second anchoring pieces extending from its one free end and anchoring portions located on the other free end to engage said terminals of the first shield plate, and further said block comprises engagement portions at said flanges at both the ends for receiving therein said first and second anchoring pieces of said first and second shield plates.

It is preferable that each of the engagement portions of the block comprises therein an inclined portion. By providing such inclined portions, the first and second anchoring pieces of the first and second shield plates can be more easily fitted into the engagement portions of the block.

Preferably, the first shield plate is provided between its folded ridge and the terminals with latches at those locations which enable the latches to engage latching portions of the connecting fixture when the first shield plate is mounted on the block. By providing the latches, the first shield plate can be securely fixed to the receptacle connector and can be prevented from moving in the width direction of the shield plate.

In a preferable embodiment of invention, the connecting fixture and the contact assemblies are constructed to form grooves therebetween on the side of the projections when the contact assemblies fixed to the connecting fixture are mounted on the block, and the first shield plate is provided between its folded ridge and the first anchoring pieces with tongues at those locations which enable the tongues to fit in the grooves between the connecting fixture and the contact assemblies. The tongues serve to fix the first shield plate to the block in a more reliable manner and prevent the first shield plate from moving in its width direction.

With the above construction according to the present invention, the following significant effects can be accomplished.

As the first and second anchoring pieces of the first and second shield plates are engaged in the engagement portions of the block, the ends of the first and second shield plates do not move away from the receptacle connector so that the stable connection between the pin connector and the receptacle connector is achieved without any deformation of the first and second shield plates and the pin contacts of the pin connector, when the pin connector and the receptacle connector are connected.

As there are provided the inclined portions in the engagement portions of the block, the first and second anchoring pieces of the first and second shield plates can be engaged in the block with ease.

As the second shield plate is securely held and fixed only by the engagement of its anchoring portions with the terminals of the first shield plate without requiring the press-fitting which would otherwise be required in the prior art, the electrical connector is easy to assemble to reduce the man-hours so as to achieve low cost.

As the terminals of the first shield plate and the anchoring portions of the second shield plate are engaged with each other, the first and second shield plates are prevented from moving away from the receptacle connector with high reliability.

As the first shield plate having the springiness is provided with the projections at the tip ends of the terminals, the terminals can easily be engaged with the anchoring portions of the second shield plate and securely prevented from disengaging therefrom.

As the first shield plate is provided with the latches which hook in the latching portions of the connecting fixture, the first shield plate is securely positioned in its thickness direction, thereby preventing the first shield plate from moving away from the receptacle connector with high reliability.

As the first shield plate is provided with the tongues, they contribute to the positioning of the first shield plate and serve to prevent the shield plate from moving in its width direction and to prevent the removal of the anchoring pieces of the first shield plate from the engagement portions of the block.

The invention will be more fully understood by referring to the following detailed specification and claims taken in connection with the appended drawings.

DESCRIPTION OF THE PREFERRED EMBODIMENTS

The electrical connector 10 according to the invention will be explained hereinafter with reference to FIGS. 1 to 6. The electrical connector 10 according to the invention comprises a receptacle connector 12 and a pin connector 32.

Figure 4:
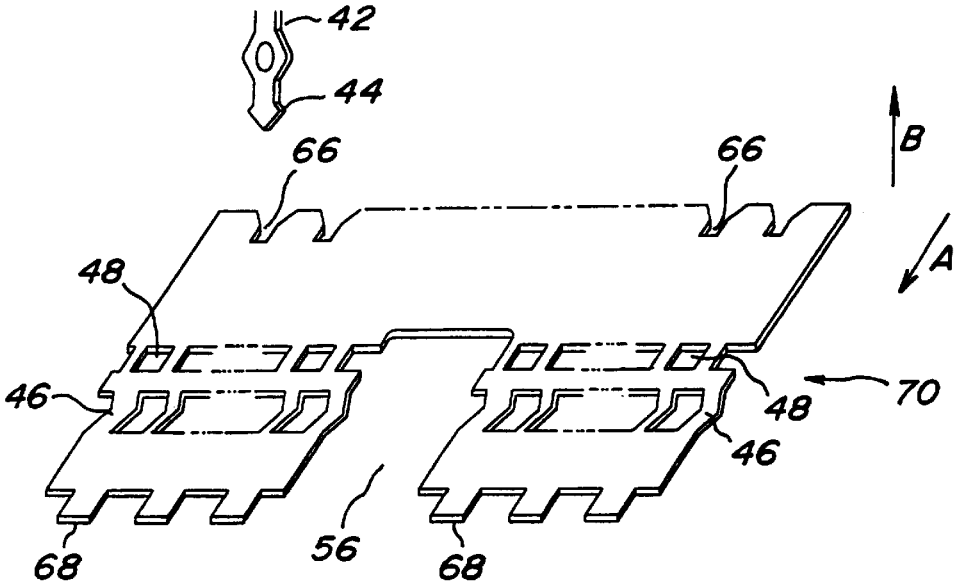
FIG. 4 is a perspective view of the second shield plate and a terminal of the first shield plate according to the invention.

First, the receptacle connector 12 will be explained herein. The receptacle connector 12 mainly comprises a block 14, contact assemblies 16, a connecting fixture 20 and first shield plate 40 and second shield plate 70 (FIG. 4).

The size of the receptacle connector 12 is in a wide range and in the shown embodiment it has a length of the order of 50 mm, a width of 20 to 23.4 mm and a thickness of 11.4 mm. The length depends upon pitches and the number of contacts. In the shown embodiment, the pitch of contacts is 2 mm and the number of the contacts is 110. The pitch of contacts may be 1.0 mm to 4.0 mm and the number of contacts is 55 to 200 which are suitably determined based on the performance and size of the connector. This receptacle connector 12 includes fitting openings 22 into which pin contacts 36 of the pin connector 32 are inserted.

The respective component parts will be explained referring to the drawings. First, the block 14 having one of the subject features of the invention will be explained. The block 14 is made of an insulating plastic material by the known injection molding in the similar manner in the prior art electrical connector. Materials from which the block 14 is made are required to have the heat-resistance and formability and to be inexpensive, and hence such materials are polybutylene terephthalate (PBT), polyamide (PA), polyphenylene sulfide (PPS), liquid crystal polymer (LCP) and the like. In consideration of the low cost, formability and dimensional stability, PBT is preferable.

On the same side of the fitting openings 22, the block 14 is provided with misinsertion preventing groove 24 for preventing misalignment insertion of the pin connector 32 into the receptacle connector 12 in the same manner as in the prior art connector, and formed on the opposite side of the fitting openings 22 with insertion apertures (not shown) into which the contact assemblies 16 are inserted. A plurality of projections 28 are provided on the block 14 at the both ends in its width direction (the vertical direction viewed in FIG. 1) on the side of the contact assemblies 16 in the same manner as in the prior art connector. These projections 28 are fitted in recesses 48 of the first and second shield plates 40 and 70.

The block 14 is provided with flanges 21 at both the ends in its width direction (the vertical direction viewed in FIG. 1) and the flanges 21 are formed with first engagement portions 26, respectively, into which are inserted first anchoring pieces 50 of the first shield plate 40 and second anchoring pieces 68 of the second shield plate 70, respectively, thereby fixing the first and second shield plates to the block 14.

Figure 2A:
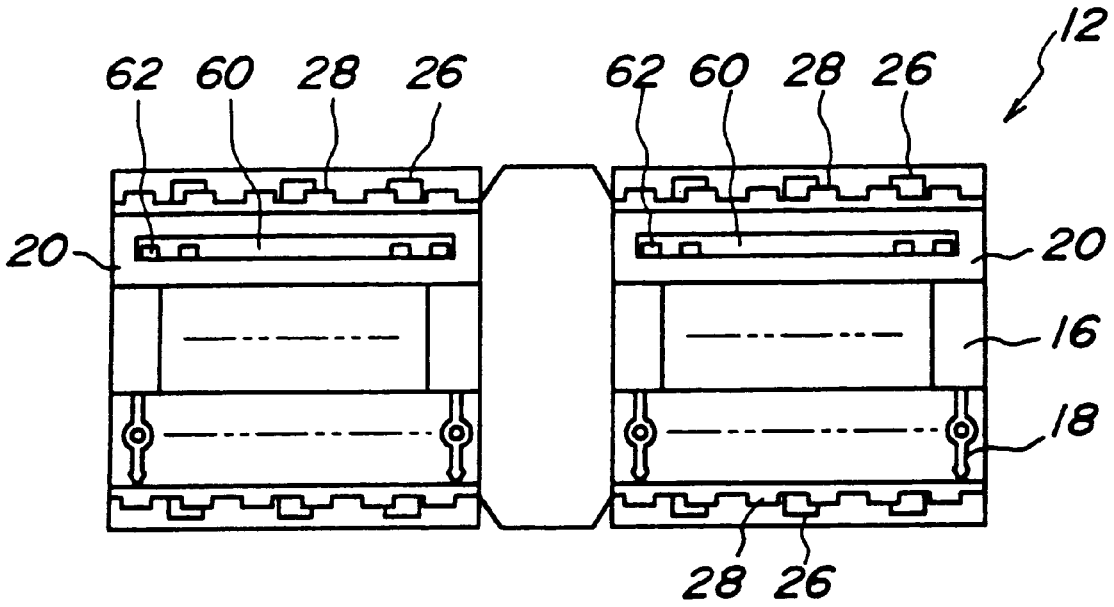
FIG. 2A is a plan view of the receptacle connector seen from the opposite side of the pin connector.
Figure 2B:
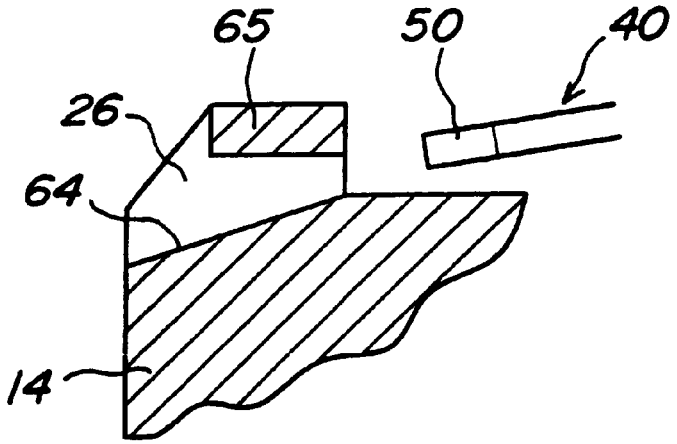
FIG. 2B is an enlarged sectional view of the engagement portion of the block into which the first anchoring piece of the first shield plate of the connector according to the invention.

The first engagement portions 26 have a shape having an inclined portion 64 and a straight portion 65 to permit the shield plate to be inserted as shown in FIG. 2B. Namely, the first anchoring piece 50 of the shield plate is inserted into the first engagement portion 26 along the inclined portion 64 and thereafter the first anchoring piece 50 is raised away from the inclined portion 64 so as to contact the straight portion 65.

The inclined angle of the inclined portion 64 is of the order of 4° to 8°. If it is not more than 4°, the insertion of the anchoring piece of the shield plate will become difficult or impossible, and if it is more than 8°, the block 14 will become weak at the portion and the first anchoring piece 50 will be likely to be dislodged therefrom. The entrance of the first engagement portion 26 has a height substantially equal to the thickness of the shield plate.

The contact assembly 16 to be inserted into the insertion aperture of the block 14 and the connecting fixture 20 will be explained together herein. The connecting fixture 20 serves to position and fix the required number of contact assemblies in their predetermined positions. The contact assembly 16 comprises an electrical insulator 17 and metallic receptacle contacts 18.

The insulator 17 is formed by the known injection molding or the like and the materials from which the insulator 17 is made are required to have the heat-resistance and formability and to be inexpensive, and hence such materials are polybutylene terephthalate (PBT), polyamide (PA), polyphenylene sulfide (PPS), liquid crystal polymer (LCP) and the like. In consideration of the low cost, formability and dimensional stability, PBT and PPS are preferable. The connecting fixture 20 is also made of an electrically insulating plastic material and materials from which the connecting fixture 20 is made are similar to those for the insulator 17.

The receptacle contact 18 comprises a contacting portion adapted to contact a pin contact 36 of the pin connector 32, a fixed portion to be held and fixed to the insulator 17 and a connecting portion to be forced into a board by press-fitting. Materials from which the receptacle contact 18 is made are beryllium copper, phosphor bronze, brass and the like which are superior in springiness. In consideration of the cost, conductivity and springiness, the phosphor bronze is preferable.

The receptacle contacts 18 are fixed to the insulator 17 by means of press-fitting, embedding them into the insulator in molding, thermal shrinkage, ultrasonic welding or the like. In the illustrated embodiment, the five receptacle contacts are fixed to the insulator. The number of the receptacle contacts are suitably determined in accordance with the specification of the electrical connector.

The contact assemblies 16 are held and fixed to the connecting fixture 20 with the protrusions 62 engaging the latching portions 60 of the connecting fixture 20 as shown in FIG. 2A in the same manner explained with the prior art connector.

When the contact assemblies 16 and the connecting fixture 20 are assembled, grooves 30 are formed between them. The grooves 30 serve to prevent the first shield plate 40 from shifting in its width direction when tongues 52 of the first shield plate 40 engage in the grooves 30. The grooves 30 may have any size so long as they can receive the tongue 52 of the first shield plate 40 therein and are suitably designed in consideration of the size and strength of the tongues 52 of the first shield plate 40. Although the grooves 30 are continuous in their longitudinal direction in the illustrated embodiment in FIG. 1, short grooves may be provided whose number and locations correspond to those of the tongues 52.

The first shield plate 40 will be explained herein which has also one of the subject features according to the present invention. The first shield plate 40 is metallic and has a substantially L-shaped cross-section which is formed by the known press-working. Materials from which the shield plate 40 is made are required to be superior in workability and springiness, and hence such materials are phosphor bronze, beryllium copper and the like. In consideration of the low cost and workability, the phosphor bronze is preferable.

The first shield plate 40 is formed at its one free end with first anchoring pieces 50 adapted to be fitted in the first engagement portions 26 of the block 14 for preventing the first shield plate 40 from moving away from the block 14. The first anchoring pieces 50 may have any shape so long as they extend outwardly to engage the first engagement portions 26. The number of the first anchoring pieces 50 is not limited so long as they fulfil the requirement with respect to their performance and is suitably designed in consideration of the size of the connector. The size of the first anchoring pieces 50 is suitably designed in consideration of the strength of the block 14 and the workability of the first shield plate 40. The first anchoring pieces 50 in the illustrated embodiment are of the order of 1.0 mm×0.4 mm.

The first shield plate 40 is further formed at its another free end with a required number of terminals 42 extending therefrom which are forced into a board (not shown) by press-fitting. Each of the terminals 42 has at its tip end a projection 44 which is adapted to be fitted in one of anchoring portions 66 of the second shield plate 70 to fix this shield plate 70 in position. The projections 44 extend from the terminals 42 about 3 mm to 5 mm which may be suitably determined in view of the relation to the anchoring portions of the second shield plate 70.

Figure 3A:
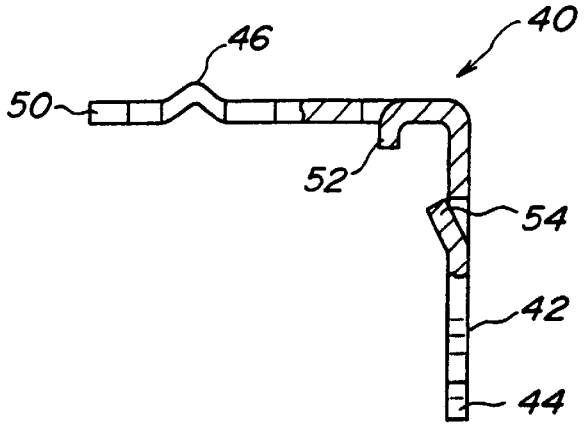
FIG. 3A is a partly sectional view of the first shield plate according to the invention.

As shown in FIG. 3A which is a partly sectional side view of the first shield plate 40, it is provided near to its folded ridge with latches 54 for engaging the latching portions 60 of the connecting fixture 20. The latches 54 are formed by cutting and raising parts of the first shield plate 40 in press-working of the shield plate. The cut and raised portions or latches 54 may have any size so long as they can engage the latching portions 60 of the connecting fixture 20 and the latches 54 are suitably designed in consideration of the strength of the connecting fixture 20 and the workability of the first shield plate 40. In the illustrated embodiment, the height of the raised parts for the latches 54 are of the order of 0.1 mm to 0.6 mm.

Figure 1:
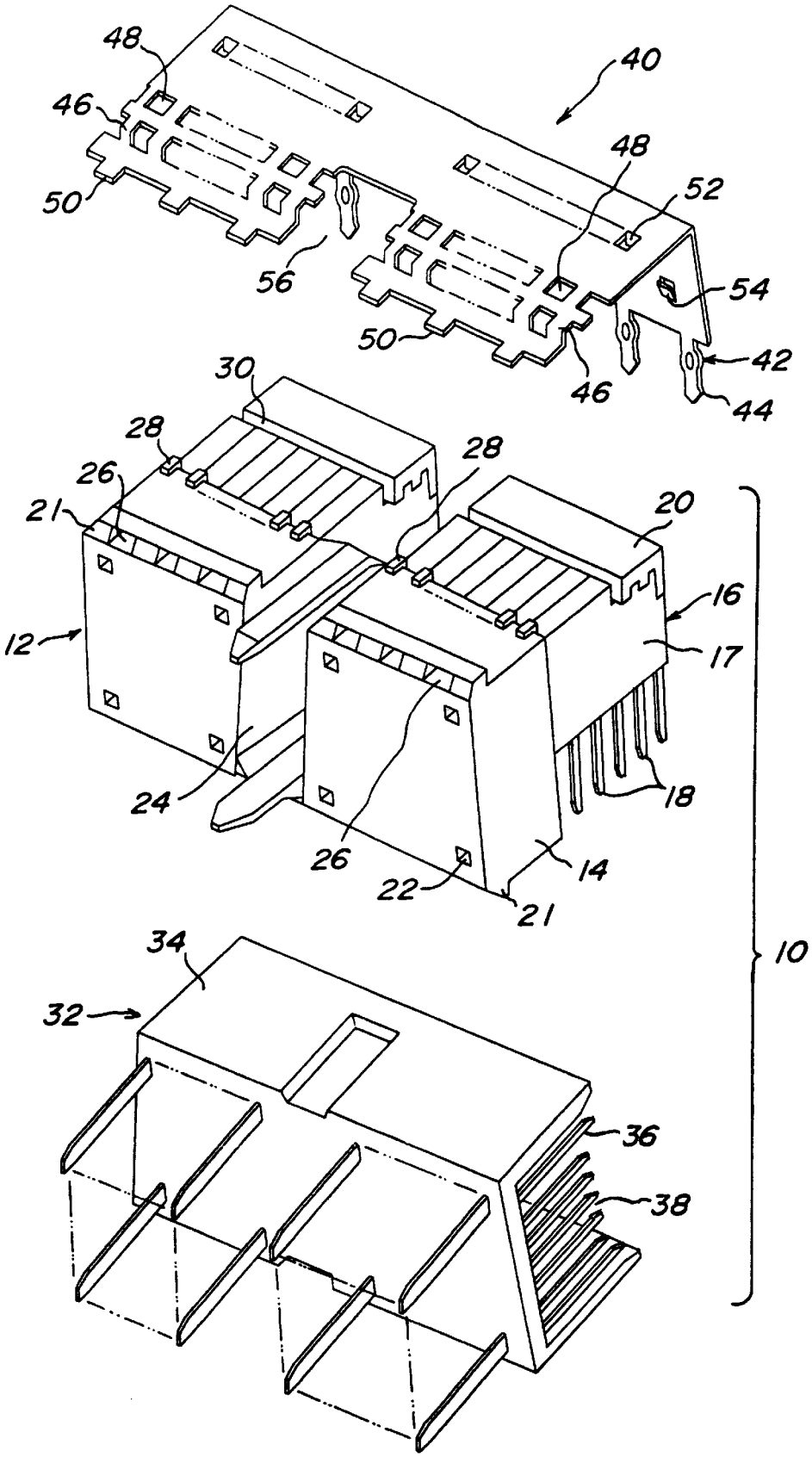
FIG. 1 is a perspective view illustrating a pin connector, and a receptacle connector and a first shield plate of the electrical connector according to the invention.

As shown in FIGS. 1 and 3A, moreover, the first shield plate 40 is formed between its folded ridge and recesses 48 with a predetermined number of tongues 52 which are formed by cutting and raising parts of the first shield plate 40 in its press-working in the same manner as in the latches 54. The tongues 52 are engaged with the grooves 30 formed between the connecting fixture 20 and the contact assemblies 16 to prevent the first shield plate 40 from shifting in the width direction. These tongues 52 may be dispensed with, if there is no risk of the recesses 48 of the first shield plate 40 removing from the projections 28 of the block 14.

In order to increase the reliability, the tongues 52 are preferably provided. Two tongues 52 at both the ends are sufficient, or at the most four tongues 52 at both the end and substantial mid portions are sufficient to perform their function. The cut and raised parts for the tongue may have any size so long as they can engage the grooves 30 and are suitably designed in considering of the workability of the first shield plate 40 and the strength of the connecting fixture 20 and the contact assemblies 16. In the illustrated embodiment, the height of the raised parts is of the order of 0.1 mm to 0.6 mm.

Near to the first anchoring pieces 50, the first shield plate 40 is formed with contacting portions 46 which are bent outwardly so that they can contact pin contacts 36 located near to the outer end of the pin connector 32 for grounding. The contacting portions may be any other shape so long as they can contact the pin contacts 36 near to the outer ends of the pin connector 32 and may be suitably designed in accordance with the contact pressure, the shape of the block 14, the strength of the shield plate and the like.

Figure 6A:
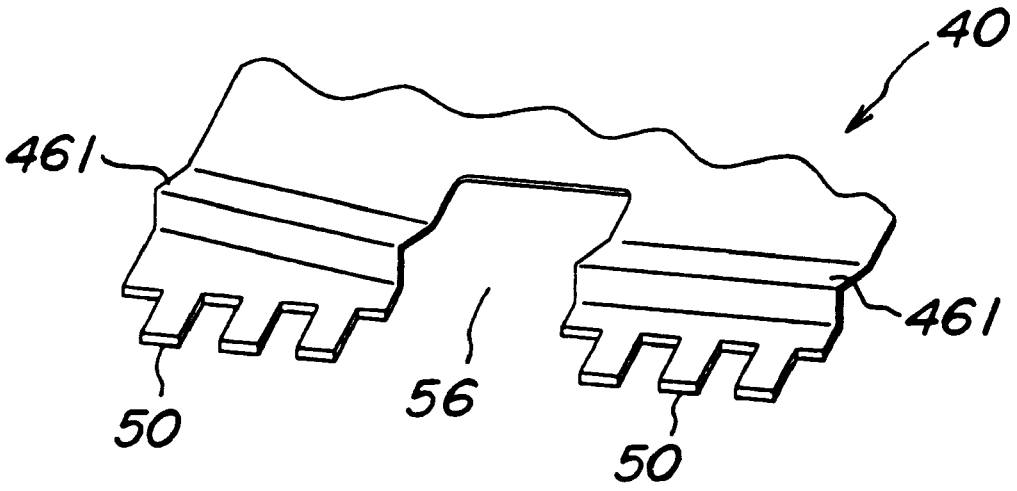
FIG. 6A is a partial perspective view of another first shield plate according to the invention illustrating its contacting portions.
Figure 6B:
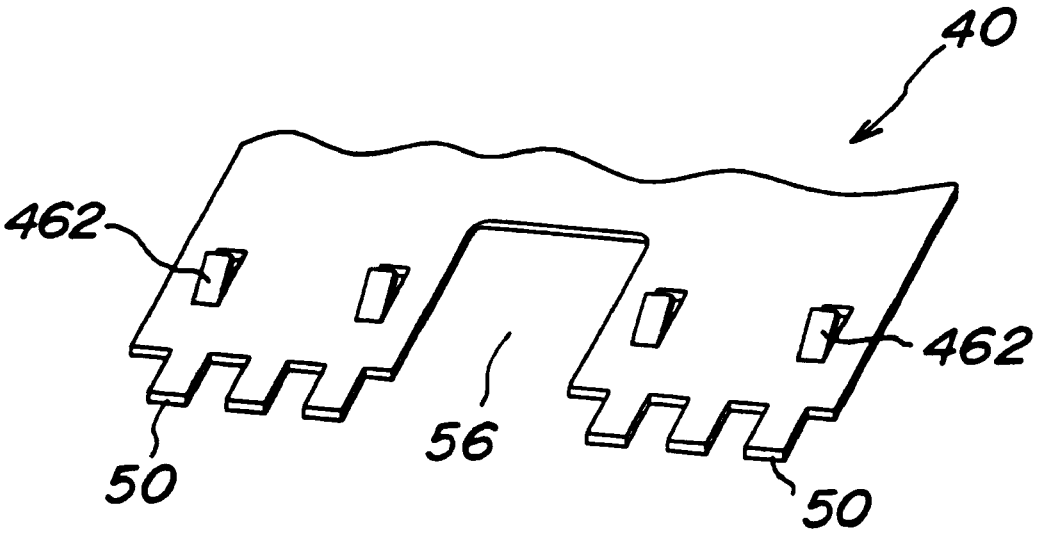
FIG. 6B is a partial perspective view of a further first shield plate according to the invention illustrating its contacting portions.
Figure 7:
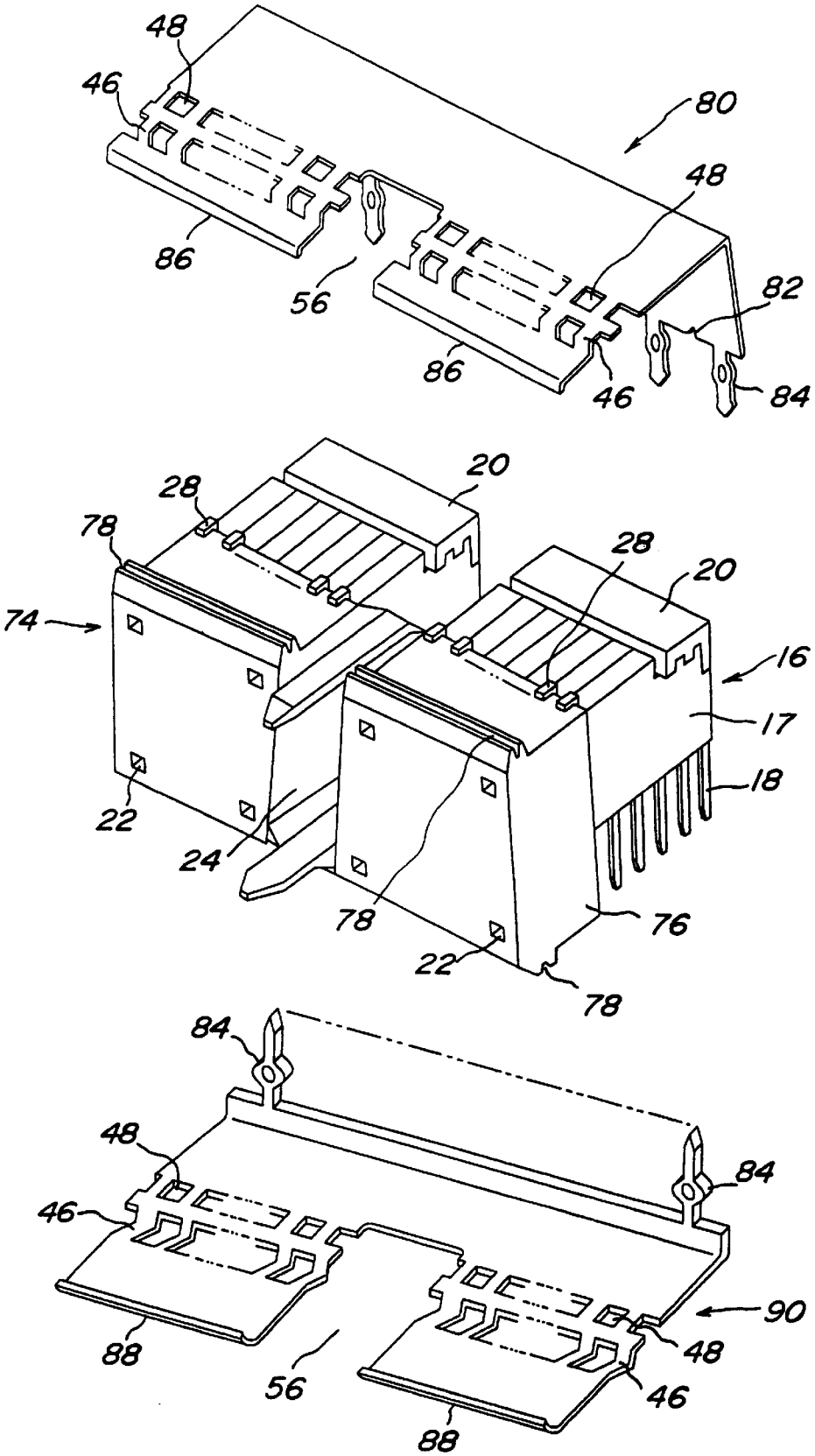
FIG. 7 (PRIOR ART)
FIG. 7 is a partly exploded perspective view of a receptacle connector and first and second shield plate of the prior art.
Figures 8, 8A:
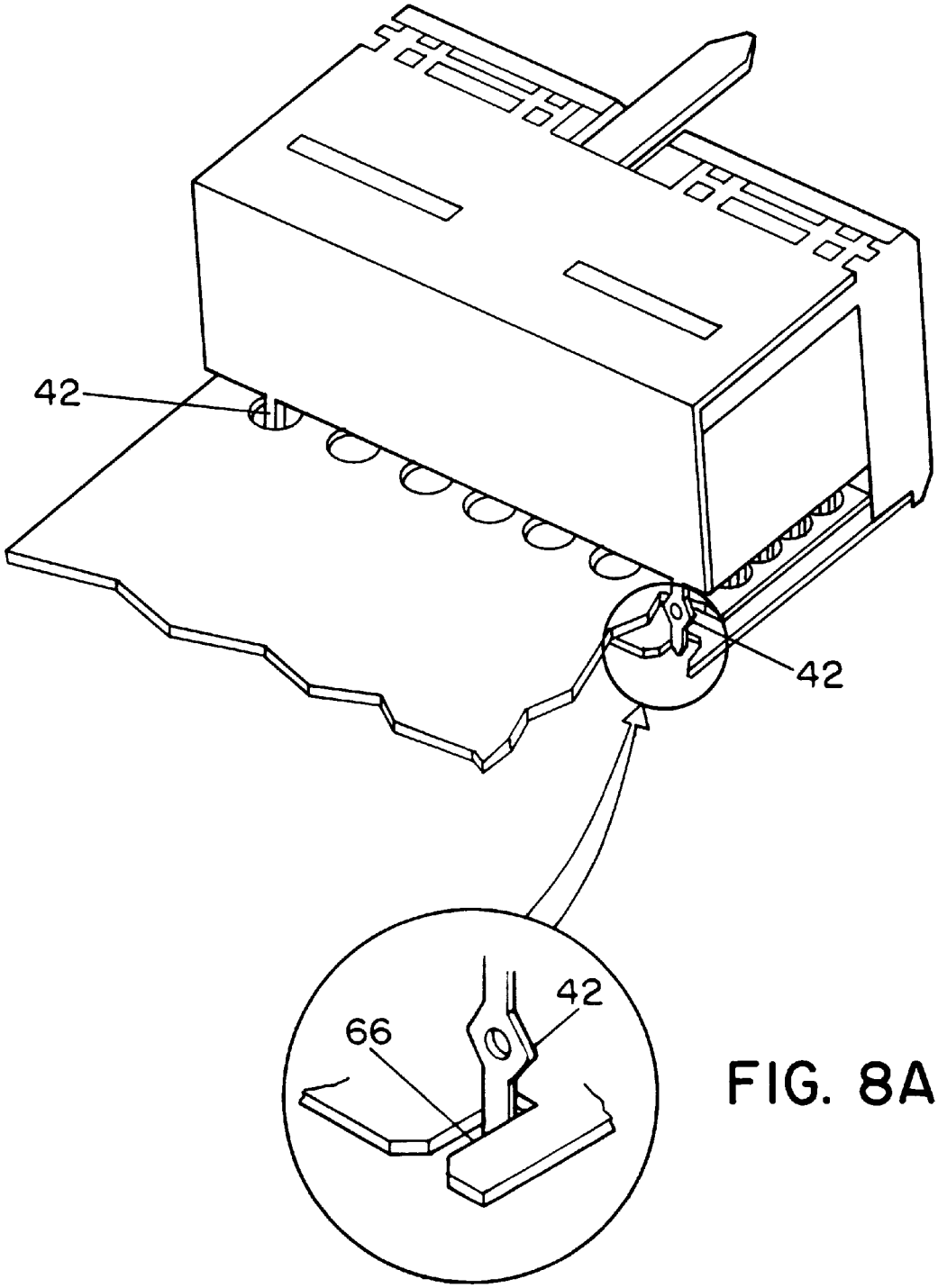
FIG. 8 is a perspective view illustrating the connector mounted on a printed circuit board.

The contacting portions may be formed as shown at numeral 461 in FIG. 6A by bending parts of the first shield plate along its entire length at the location corresponding to the contacting portions 46 of the first shield plate 40 or as shown at numeral 462 in FIG. 6B by partially cutting the first shield plate and raising the cut portions from the first shield plate. The contacting portions 46 of the second shield plate 70 later described may be also formed in the same manner as the contacting portions 46, 461 or 462 of the first shield plate.

Near to the contacting portions 46, moreover, the first shield plate 40 is formed with recesses 48 at locations enabling the projections 28 of the block 14 to fit into the recesses 48. The recesses 48 have a size suitably designed to receive the projections 28. In the illustrated embodiment, the recesses 48 are approximately 0.1 mm to 0.4 mm larger than the projections 28 of the block 14.

Figure 3B:
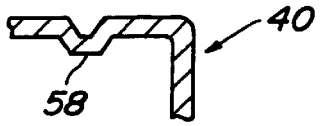
FIG. 3B illustrates a modification of the tongue of the first shield plate according to the invention.

Although the latches 54 and the tongues 52 are formed by cutting and raising parts of the first shield plate 40 as shown in FIG. 3A, they may be provided in the form of projections as shown by numeral 58 in FIG. 3B. The projections 58 may be suitably designed so as to extend from the shield plate such that they can engage the respective mating portions. Moreover, the first shield plate 40 is formed with a relief space 56 to facilitate the mounting of the shield plate onto the block 14.

The second shield plate 70 will be explained herein with reference to FIG. 4, which has also one of the subject features according to the present invention. The second shield plate 70 is metallic and substantially flat. Materials from which the second shield plate is made are required to be superior in workability, springiness and the like, and hence such materials are phosphor bronze, beryllium copper and the like. In consideration of the low cost and workability, the phosphor bronze is preferable.

The second shield plate 70 is provided at one free end with second anchoring pieces 68 adapted to be fitted in the first engagement portions 26 of the block 14 for preventing the second shield plate 70 from moving away from the block 14. The second anchoring pieces 68 may have any shape so long as they extend outwardly to engage the first engagement portions 26. The number and size of the second anchoring pieces 68 are selected in the same manner as in the first anchoring pieces 50 of the first shield plate 40.

The second shield plate 70 is also provided at the other free end with a required number of anchoring portions 66 adapted to engage the terminals 42 of the first shield plate 40. The second shield plate 70 is fixed to the first shield plate 40 with the projections 44 of the terminals 42 engaging in the anchoring portions 66. The anchoring portions 66 shown in FIG. 4 are formed only by slitting and have chamfered or rounded edges at their outer ends in order to facilitate the engagement with the terminals of the first shield plate. The widths of the anchoring portions 66 forming slits are about 0.05 mm to 0.2 mm narrower than those of the projections 44 of the terminals 42.

The second shield plate 70 is further provided on the side of the anchoring pieces 68 with contacting portions 46 which are bent outwardly so that they can contact pin contacts 36 located near to the outer end of the pin connector 32 for grounding. Although the contacting portions 46 are able to contact the pin contacts 36 discretely in the illustrated embodiment, they may be formed in other shapes such as 461 and 462 explained with the first shield plate 40 referring to FIGS. 6A and 6B.

Near to the contacting portions 46, furthermore, the second shield plate 70 is formed with recesses 48 at locations enabling the projections 28 of the block 14 to fit into the recesses 48. The recesses 48 have a size suitably designed to receive the projections 28. In the illustrated embodiment, the recesses 48 are of the order of 0.1 mm to 0.4 mm larger than the projections 28 of the block 14. Moreover, the second shield plate 70 is formed with a relief space 56 to facilitate the mounting of the shield plate onto the block 14.

Another embodiment of the anchoring portions 66 of the second shield plate 70 will be explained with reference to FIGS. 5A to 5C. Although the anchoring portions 66 shown in FIG. 4 are formed by slitting, they may be formed by cutting and raising parts of the second shield plate 70 so that between the thus formed plate-shaped pieces 72, 721 or 722 the terminals 42 are engaged.

Figure 5A:
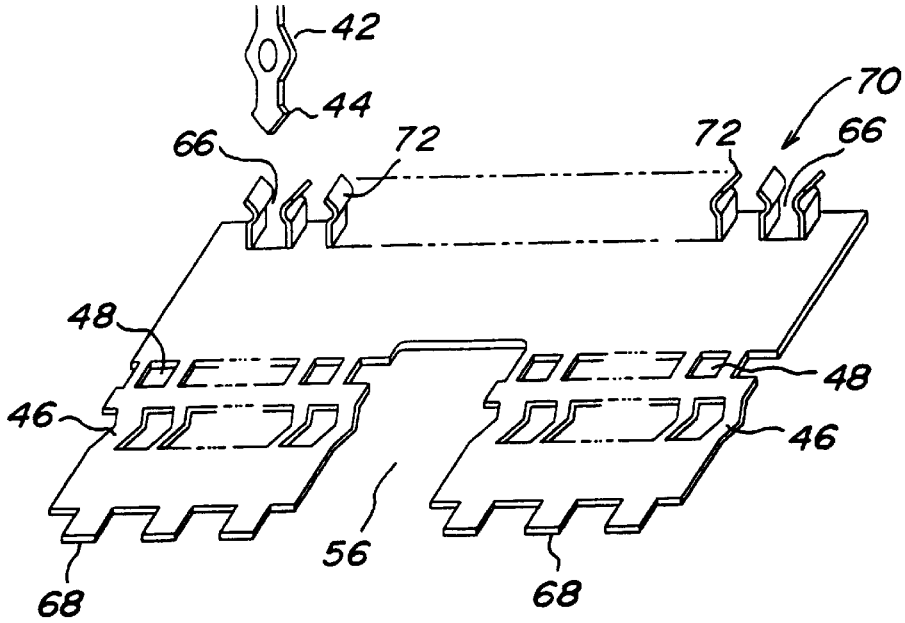
FIG. 5A is a perspective view of a modification of the second shield plate and a terminal of the first shield plate according to the invention.

In FIG. 5A, the anchoring portions 66 are formed by cutting and raising parts of the second shield plate 70 and bending the pairs of adjacent raised plate-shaped pieces 72 at their center so as to extend inwardly to ensure the engagement with the projections 44 of the terminals 42. In FIG. 5B, the anchoring portions 66 are formed by partially cutting the second shield plate 70 and partially raising only those parts of the cut pieces 721 associated with the terminals 42 without raising the entire cut pieces. In FIG. 5C, the anchoring portions 66 are formed by partially cutting the second shield plate 70 and deforming the cut pieces 722 at their center so as to extend inwardly without bending.

Finally, the method for assembly the receptacle connector according to the present invention will be explained. First, the receptacle contacts 18 are fixed to the insulators 17 to form contact assemblies 16 by press-fitting, embedding them in the insulators in molding or the like. The contact assemblies 16 with the receptacle contacts 18 are then mounted on the connecting fixture 20. The contact assemblies 16 in this condition are press-fitted and fixed in the insertion apertures of the block 14.

The first shield plate 40 is then mounted on the block 14 in a manner that the first anchoring pieces 50 of the first shield plate 40 in an inclined position are inserted into the first engagement portions 26 and the first shield plate 40 is then forced into such a position that the projections 28 of the block 14 enter the recesses 48 of the first shield plate 40 and the tongues 52 of the first shield plate 40 enter the grooves 30 of the connecting fixture 20. The free end of the first shield plate 40 on the side of the terminals 42 is lowered downward so that the latches 54 of the first shield plate 40 enter the latching portions 60 (FIG. 2A) of the connecting fixture 20 to complete the mounting of the first shield plate 40 on the block 14.

The connectors each having a first shield plate 40, and second shield plates are sent to customers. The connector equipped with the first shield plate 40 is then forced into a board by press-fitting so that the projections 44 of terminals 42 of the first shield plate 40 extend through the board.

The second anchoring pieces 68 of the second shield plate 70 as shown in FIG. 4 are inserted into the first engaging portions 26 of the block 14 in the same manner as in the first shield plate 40. Then, the second shield plate 70 having a springiness is moved toward the board in the direction shown by an arrow B, while the second shield plate 70 is being deformed in the direction shown by an arrow A. After moving in the direction B, the second shield plate 70 contacting the block 14 is released so that the second shield plate 70 moves with the aid of its elastically restoring force in the direction opposite to the direction A, with the result that the anchoring portions 66 engage the terminals 42 with the slits of the anchoring portions 66 engaging the upper portions of the projections 44 of the terminals 42 of the first shield plate 40, respectively, to complete the mounting of the second shield plate 70.

Figure 5B:
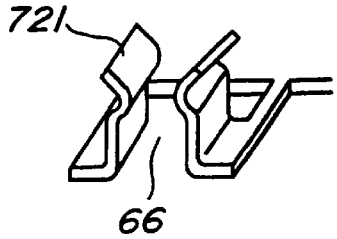
FIG. 5B is a perspective view of a modification of the anchoring portion of the second shield plate according to the invention.
Figure 5C:
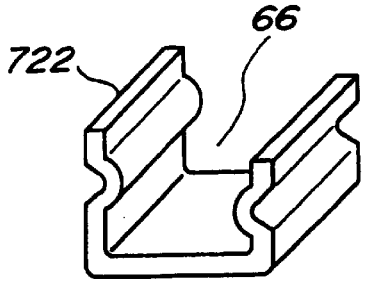
FIG. 5C is a perspective view of another modification of the anchoring portion of the second shield plate according to the invention.

In the cases of the second shield plates 70 shown in FIGS. 5A to 5C, after the second anchoring pieces 68 have been inserted into the first engagement portions 26 of the block 14 in the same manner as the first shield plate 40, the second shield plate 70 is brought into such a position that the projection 28 of the block 14 enter the recesses 48 of the second shield plate 70. The end of the second shield plate 70 on the side of the anchoring portions 66 is then lowered downward so that the projections 44 of the terminals 42 of the first shield plate 40 will engage the anchoring portions 66 of the second shield plate 70 to complete the mounting of the second shield plate 70 on the block 14 and the first shield plate 40.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector comprising a pin connector and a receptacle connector, said pin connector comprising a housing having a fitting groove in which said receptacle connector is fitted and pin contacts held and fixed to said housing, and said receptacle connector comprising contact assemblies, each of said contact assemblies including an insulator and receptacle contacts fixed to said insulator, each receptacle contact having a contacting portion to contact one of said pin contacts, a fixed portion fixed to said insulator and a connecting portion secured in a board by press-fitting; a connecting fixture for holding said contact assemblies with their protrusions engaging latching portions; a block including fitting openings on a pin side of the block into which said pin contacts are inserted, flanges at both ends of said block in its width direction, insertion apertures in one surface of said block facing to said insulator into which said contact assemblies are inserted, and a required number of projections at both ends of said block in its width direction on said one surface of said block, a first shield plate to be mounted on said block and including contacting portions located near to one free end of the first shield plate to contact said pin contacts, a required number of terminals on a second free end to be forced into the board by press-fitting and first recesses at locations enabling said projections of said block to be inserted in the first recesses; and a second shield plate to be mounted on said block and including second contacting portions located near to one free end of the second shield plate to contact said pin contacts and second recesses at locations enabling said projections of said block to be inserted in the second recesses, wherein said first shield plate has a substantially L-shaped cross-section and comprises a required number of first anchoring pieces extending from said one free end and projections at tip ends of said terminals on said second free end, and said second shield plate comprises a required number of second anchoring pieces extending from said one free end of the second shield plate and anchoring portions located on a second free end of the second shield plate to engage said terminals of the first shield plate, and wherein said block comprises engagement portions at said flanges for receiving therein said first and second anchoring pieces of said first and second shield plates.

2. The electrical connector as set forth in claim 1, wherein each of said engagement portions of the block comprises therein an inclined portion.

3. The electrical connector as set forth in claim 2, wherein the inclined angle of said inclined portion is within a range of 4° to 8°.

4. The electrical connector as set forth in claim 1, wherein said first shield plate is provided between its folded ridge and the terminals with latches at those locations which enable said latches to engage latching portions of said connecting fixture when the first shield plate is mounted on said block.

5. The electrical connector as set forth in claim 4, wherein said latches are formed by cutting and raising parts of the first shield plate in press-working of the first shield plate.

6. The electrical connector as set forth in claim 1, wherein said connecting fixture and said contact assemblies are constructed to form grooves therebetween on a side of said projections associated with said first shield plate when said contact assemblies fixed to the connecting fixture are mounted on said block, and said first shield plate is provided between its folded ridge and said first anchoring pieces with tongues at those locations which enable said tongues to fit in said grooves between said connecting fixture and said contact assemblies.

7. The electrical connector as set forth in claim 6, wherein said tongues are formed by cutting and raising parts of the first shield plate in press-working of the first shield plate.

8. The electrical connector as set forth in claim 6, wherein said tongues are in the form of projections.

9. The electrical connector as set forth in claim 1, wherein each of said anchoring portions of said second shield plate is formed by slitting the second shield plate and has chamfered or rounded edge at its outer end.

10. The electrical connector as set forth in claim 1, wherein each of said anchoring portions of said second shield plate is formed by cutting and raising parts of the second shield plate and bending a pair of adjacent raised plate-shaped pieces at their center so as to extend inwardly toward each other.

11. The electrical connector as set forth in claim 1, wherein each of said anchoring portions of said second shield plate is formed by partially cutting the second shield plate and partially raising only those parts of the cut pieces associated with said terminals of the first shield plate.

12. The electrical connector as set forth in claim 1, wherein each of said anchoring portions of said second shield plate is formed by partially cutting the second shield and deforming the pairs of cut pieces at their center so as to extend inwardly toward each other without bending.

* * * * *